US005368090A

United States Patent [19]

Ungar et al.

[11] Patent Number: 5,368,090

[45] Date of Patent: Nov. 29, 1994

[54] GEOMETRICAL VAPOR BLOCKER FOR PARALLEL CONDENSATION TUBES REQUIRING SUBCOOLING

[76] Inventors: Eugene K. Ungar, 16460 Hwy. 3, #306, Webster, Tex. 77598; William D. Harwell, 12518 Wrenthorpe Dr., Houston, Tex. 77031; John D. Cornwell, Rte. 1, Box 730, San Leon, Tex. 77539

[21] Appl. No.: 115,832

[22] Filed: Sep. 3, 1993

[51] Int. Cl.[5] ..... F28B 11/00

[52] U.S. Cl. ..... 165/1; 165/110; 165/174; 165/913; 29/890.037

[58] Field of Search ..... 165/110, 1, 174, 913; 29/890.07

[56] References Cited

U.S. PATENT DOCUMENTS

| | | | |
|---|---|---|---|
| 1,816,159 | 7/1931 | Smith | 165/174 |
| 2,158,792 | 5/1939 | Erbach | 165/174 |
| 5,139,083 | 8/1992 | Larinoff | 165/113 |

FOREIGN PATENT DOCUMENTS

| | | | |
|---|---|---|---|
| 3045731 | 7/1982 | Germany | 165/174 |

*Primary Examiner*—Albert W. Davis, Jr.
*Attorney, Agent, or Firm*—Edward K. Fein; Guy M. Miller; Hardie R. Barr

[57] ABSTRACT

An apparatus and method is disclosed for regulating flow of working fluid through parallel condensation tubes requiring subcooling. The apparatus provides an elongated restriction element extending into the outlet of the respective condensation tubes to the approximate point of onset of subcooling. The elongated restriction element is braced externally to the condensation tube with a support that is used for positioning and maintaining the elongated restriction element in the correct position. The elongated restriction element has a pentagonal cross-section and is slightly undersize with respect to the working fluid passageways through the condensation tubes. The restriction member significantly restricts flow of partially vaporized working fluid but does not significantly affect the flow of fully liquid working fluid.

12 Claims, 3 Drawing Sheets

GEOMETRICAL VAPOR BLOCKER FOR PARALLEL CONDENSATION TUBES REQUIRING SUBCOOLING

ORIGIN OF THE INVENTION

The invention described herein was made by employees of the United States Government and may be manufactured and used by or for the Government of the United States of America for governmental purposes without payment of any royalties thereon or therefore.

TECHNICAL FIELD

The present invention relates to apparatus and methods for regulating the flow of a working fluid through radiator condensing tubes. More particularly, the present invention is directed to apparatus and methods for regulating flow through parallel condensation tubes connected to common input and output manifolds.

BACKGROUND ART

Two-phase cooling systems used in space-based operations may employ parallel condensation tubes in a radiator for removing heat from the cooling system. A working fluid in the cooling system, such as ammonia, efficiently absorbs heat, is vaporized, and is then circulated through the radiator for heat removal (condensation). To make the most efficient use of the available heat rejection area of the radiator, it is generally desirable to have the working fluid flow uniformly through the parallel condensation tubes of the radiator. As the working fluid flows through the condensation tubes, the absorbed heat is removed, so that condensed fluid may be pumped back to the heat generating source.

In space-based cooling systems, subcooling of the working fluid, i.e., cooling below its saturation temperature (boiling point), is normally required for practical operation of the working fluid pump. While a gravity feed pump for the working fluid at saturation temperature may be possible in an earth-based cooling system, gravity feed is not possible for space-based cooling systems.

Non-uniform working fluid flow through the parallel condensation tubes of a radiator varies the amount of subcooling provided by each radiator tube. The tubes with higher flow rates will have warmer fluid at their exits. Additional subcooling must be obtained to make up for any lack of local subcooling caused by the non-uniform flow. Additional subcooling obtained from other condensation tubes lowers the average radiator temperature, and thus decreases the radiator heat rejection capability.

In current practice, two techniques are generally used to equalize the working fluid flow through the radiator condensation tubes. These techniques result generally in a relatively lower pressure drop in both the input and output manifolds compared with the pressure drop across the condensation tubes. In this way, these techniques bias the working fluid flow through each of the condensation tubes towards equalization.

According to one technique, the internal diameter of the working fluid input and output manifolds separating the parallel condensation tubes is increased. This technique lowers the pressure drop over the length of the manifolds, so that the manifold pressure drop is small in comparison to the pressure drop across the condensation tubes.

According to a second technique, the pressure drop across the condensation tubes may be increased by decreasing the tube size or by placing an orifice at the condensation tube outlet. This technique also makes the input manifold pressure drop small in comparison to the condensation tube pressure drop.

In space-based cooling systems, the manifolds may be in the range of seventy feet long and the condensation tubes in the range of twelve feet long. The difficulties involved in placing large cooling system equipment in space severely limit weight and volume allowances including the available internal diameter of the manifolds. Thus, normal specifications for a space-based cooling system eliminate the first technique commonly used to improve flow distribution.

Energy limitations in a space-based cooling system also restrict the power available for the pump that may be used in the system to overcome a pressure drop. The total pressure drop available for use over the length of the condenser tubes is therefore limited. Thus, space-based system requirements also practically eliminate the second flow distribution option of increasing the pressure drop across the condensation tubes.

Various inventors have considered some aspects of these problems. U.S. Pat. No. 4,899,810 to J. E. Fredley discloses a low pressure drop condenser/heat exchanger which contemplates elimination of a mechanical pump for inducing working fluid flow. The two-phase system is designed for operation in a micro-gravity environment and includes a capillary pumped loop with a wicked evaporator that produces a working fluid vapor head of about ½ PSI upon absorbing heat from a heat source. A heat exchanger for receiving working fluid vapor from the wicked evaporator includes a manifold to direct the vapor to a plurality of parallel fluid channels helically wound about and thermally coupled with a heat pipe that attaches to a radiator panel. If this system were to use a large number of similar heat exchangers, spaced in parallel along a substantially long, small diameter manifold, some mechanism would likely be necessary to distribute the vapor flow evenly between the heat exchangers.

U.S. Pat. No. 5,139,083 to M. L. Larinoff discloses an air cooled vacuum steam condenser with flow-equalized mini-bundles. This device effectively demonstrates a variation of the technique of using an orifice at the tube outlet. A single-row, two-pass steam condensing bundle is used for condensing steam in air-cooled vacuum steam condensers. Each mini-bundle set has one centrally located second pass tube with symmetrically disposed first pass tubes positioned on either side. The steam leaving each first pass tube is controlled by a flow equalizing device installed at the end of the tubes. The flow of gas mixture leaving each second pass tube is controlled by an individual orifice in the gas piping system.

U.S. Pat. No. 4,945,010 to Kaufman et al. discloses a cooling assembly for fuel cells whereby working fluid is circulated through a conduit arranged in serpentine fashion within a member of the cooling assembly. The conduit can be constructed as a single, manifold-free, continuous working fluid passage means having only one inlet and one outlet. Kaufman et al. disclose no means to equalize working fluid flow through multiple conduits by varying in resistance along the flow path of the working fluid.

U.S. Pat. No. 5,085,058 to Aaron et al. discloses a bi-flow expansion device for a heat pump or other apparatus where fluid travel is reversed with different required flow rates in each direction to obviate the need for two expansion devices. This device is used in a single flow line with a large pressure drop and does not equalize working fluid flow through multiple condensation tubes.

The prior art disclosures discussed above, where applicable, provides no more than variations of the generally known techniques for equalizing flow in parallel condensation tubes that require subcooling of the working fluid. Thus, a need exists for additional useful flow equalization mechanisms, particularly for a space-based cooling systems whose requirements severely restrict weight, space, and power allowances. Those skilled in the art will appreciate the novel features of the present invention that solves these and other problems.

STATEMENT OF THE INVENTION

The present invention includes methods and apparatus for regulating fluid flow through a plurality of parallel condensation tubes connecting to a common input manifold. A working fluid, at least partially in a vapor phase, flows into the input manifold, is distributed among the condensation tubes, condenses, and flows from the condensation tubes to an output manifold.

Each condensation tube has a passageway for flow of working fluid along the length of the tube. The working fluid enters an inlet port at one end of the condensation tube and exits at an outlet port at the opposite end. Heat radiation surfaces are thermally connected to the condensation tube to remove heat from the working fluid as it flows through the condensation tube. At some point in the condensation tube, the working fluid is cooled to its saturation temperature. After that point, the working fluid is subcooled as it moves along the passageway.

To enhance working fluid flow equalization in the present invention, an elongated restriction member or distributed restriction is placed in the passageway through the condensation tube proximal to the outlet port. In a preferred embodiment, the elongated restriction member is supported at a point external to the outlet port and extends into a portion of the condensation tube adjacent the outlet port. The support prevents movement of the elongated restriction member within the condensation tube but allows for easy placement of the restriction member.

The method of the present invention includes steps related to the above recited apparatus structure. As previously stated, the at least partially vaporized working fluid is introduced into the common input manifold. The working fluid, including vaporized fluid, is then directed by the input manifold to the inlets of the condensation tubes. As heat is removed from the working fluid, the working fluid condenses and, at some point in the condensation tube which may be calculated, subcooling of the working fluid begins to occur. A restriction member is placed within the subcooling region of the passageway through the condensation tube. The subcooling region is in a portion of the condensation tube adjacent the outlet of the condensation tube. The restriction member has little effect on liquid working fluid flow through the passageway. However, the restriction member significantly increases flow resistance to partially vaporized working fluid that becomes present as subcooling at the tube exit is diminished.

One cause of diminished subcooling, in a condensation tube may be attributable to an increase in working fluid flow through the condensation tube, thereby causing an increase in the vapor content of the working fluid near the outlet of the condensation tube. The present invention, in this case, automatically increases flow resistance to reduce fluid flow through this condensation tube. This increased resistance in one tube induces increased flow through other condensation tubes. Thus, flow in the parallel condensation tubes tends towards equalization. The position where the vapor condenses in the tube and thus the onset of subcooling is also largely equalized among the parallel condensation tubes by this method.

An objective of the present invention is to provide flow equalization in parallel condensation tubes responsive to the quantity of vaporized working fluid flow through some of the condensation tubes.

Another objective of the present invention is to provide little or no change in resistance for working fluid flow in a liquid phase through a condensation tube of a radiator, while automatically increasing resistance to working fluid flow through the condensation tubes passing working fluid in a partially vaporized state to the outlet manifold.

A feature of the present invention is the use of an elongated restriction member disposed within the condensation tubes for providing variable restriction flow.

Another feature of the present invention is the use of an external support to easily fix the position of the elongated restriction member within the flow passageway of the restriction tube.

An advantage of the present invention is the relative simplicity of manufacturing pentagonal cross-sectional elongated restriction elements.

Another advantage of the present invention is a decrease in susceptibility to non-uniform working fluid flow through the condensation tubes in response to an increase in pressure drop across the input manifold.

Other features and intended advantages of the present invention will be readily apparent by the references to the following detailed description in connection with the accompanying drawings.

While the invention will be described in connection with the presently preferred embodiments, it will be understood that the invention should not be limited by this description of these embodiments. On the contrary, the invention is intended to cover all alternatives, modifications, and equivalents as may be included in the spirit of the invention.

DESCRIPTION OF THE PREFERRED EMBODIMENTS

The present invention describes an apparatus and method useful for regulating working fluid flow through a plurality of parallel condensation tubes which require subcooling of the working fluid over a portion of their length. A distributed restriction developed with an elongate restriction element is used in an area of the condensation tube where subcooling is expected to normally take place i.e., the vicinity adjacent the exit port of the condensation tube. Thus, working fluid is normally liquified as it flows through this area.

The restriction element does not significantly affect liquid flow of working fluid. However, if subcooling is diminished for some reason, and partially vaporized working fluid flows through this area, the restriction element significantly increases resistance to working fluid flow. This variable restriction action is used for passive regulation of the working fluid flow through the radiator.

Figure 3:
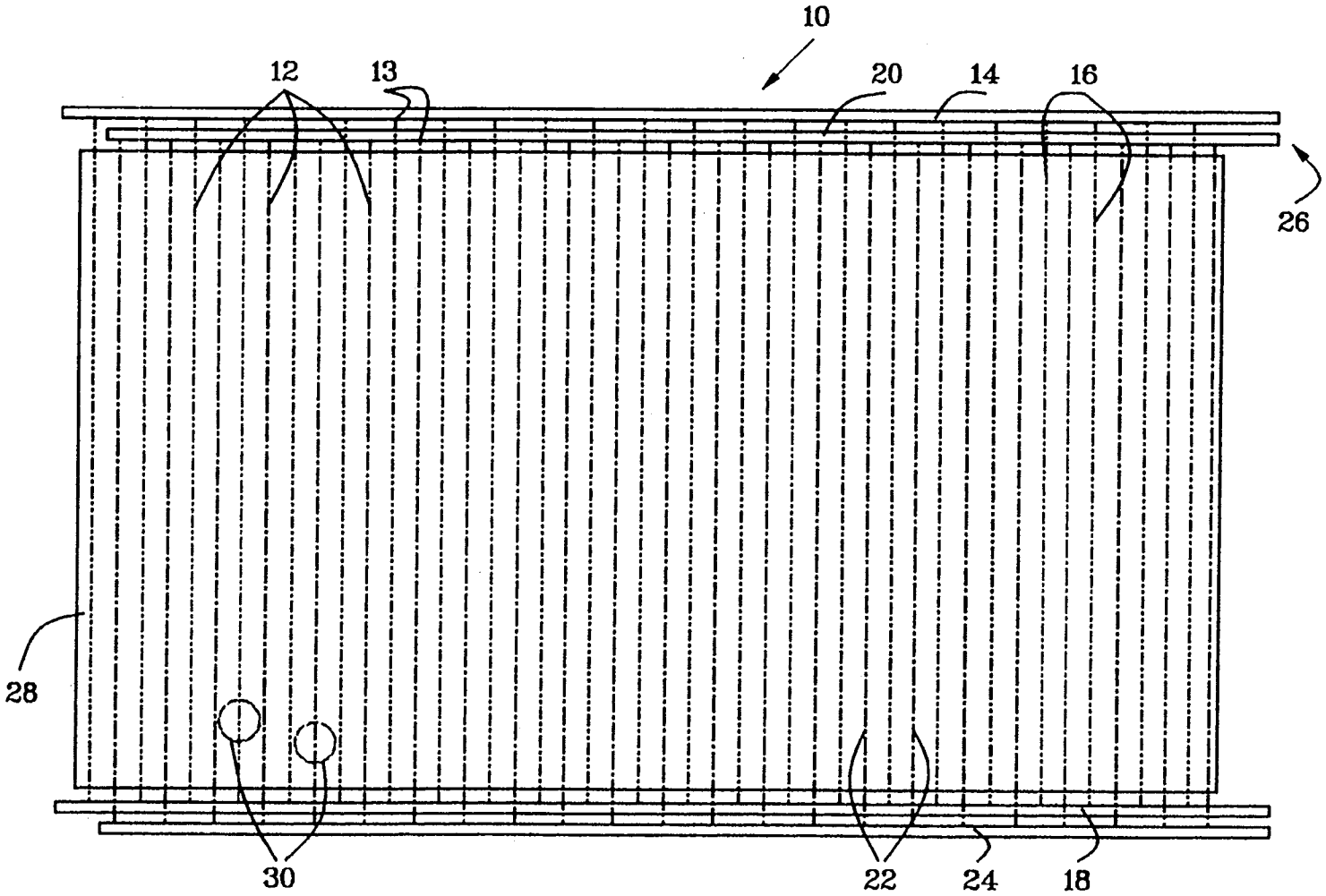
FIG. 3 is a diagrammatic representation of a radiator assembly in accord with the present invention.

Referring to the drawings, and more specifically to FIG. 3, there is shown a schematic of radiator assembly 10, or at least a portion thereof, which may be suitable for a spaced-based cooling system. One preferred embodiment of the present invention includes two sets of eighty-eight parallel condensing flow paths through the corresponding parallel condensation tubes shown schematically as condensation tubes 12. Each condensation tube 12 has an inlet 13 connected to a corresponding vapor inlet manifold 14, 20.

Radiator assembly 10 includes loops A and B, which function in parallel. A includes loop A vapor inlet manifold loop 14, unit A parallel condensation flow paths 16 which connect to inlet manifold 14, and loop A liquid outlet manifold 18. Similarly, radiator loop B includes loop B vapor inlet manifold 20, loop B parallel condensation flow paths 22 which connect to inlet manifold 20, and loop B liquid outlet manifold 24. Radiator facesheet 28 covers radiator loops A and B.

Vaporized working fluid, containing heat to be removed, enters vapor inlet manifolds 14 and 20 at their respective entrances 26. In a preferred embodiment, ammonia is used as a working fluid in the radiator system because of its high heat of vaporization (510 BTU/1 bm) and its relatively low freezing point (−108° F.). However, other working fluids could also be used in accord with the present invention.

In a preferred embodiment, manifolds 14, 18, 20, and 24 are approximately 69 feet long and there are 88 tubes each in loop A and loop B. If flow maldistribution through the condensation tubes causes a requirement for additional subcooling in some of the condensation tubes, the average radiator temperature is lowered. Lower average radiator temperature decreases the radiator heat rejection capability which may be critical when the radiator is placed in the environment of an effective space temperature of approximately −40° F. where a space station may be constructed at an orbital position from Earth.

For a space-based cooling system, it is not practical to significantly increase the internal diameter of the respective manifolds to equalize the pressure drop across condensing tubes 12. Nor is it practical to significantly increase the pressure across condensing tubes 12 to minimize the effect of a pressure drop over the length manifolds 14, 18, 20 and 24. Power limitations in the system pump limit the pressure drop across condensing tubes 12 to the range of approximately 145 psf (pounds per square foot) or 1 psi (pounds per square inch) for the tubes near the entrance 26 of inlet manifolds 14 and 20.

For proper operation of the pump (not shown), it is necessary that working fluid be subcooled or cooled below its saturation temperature (boiling point). The amount of subcooling is given by the saturation temperature minus the local temperature of the working fluid. Subcooling will generally begin to occur, in the present design, near the end of condensing tubes 12 adjacent to the liquid outlet manifolds 18 and 24, and in the approximate region 30 shown in FIG. 1. The position of region 30 varies according to heat load. The present invention takes advantage of the fact that resistance to working fluid flow past a restriction is not significantly increased for liquified flow, but does increase significantly for partially vaporized working fluid flow.

Figure 1:
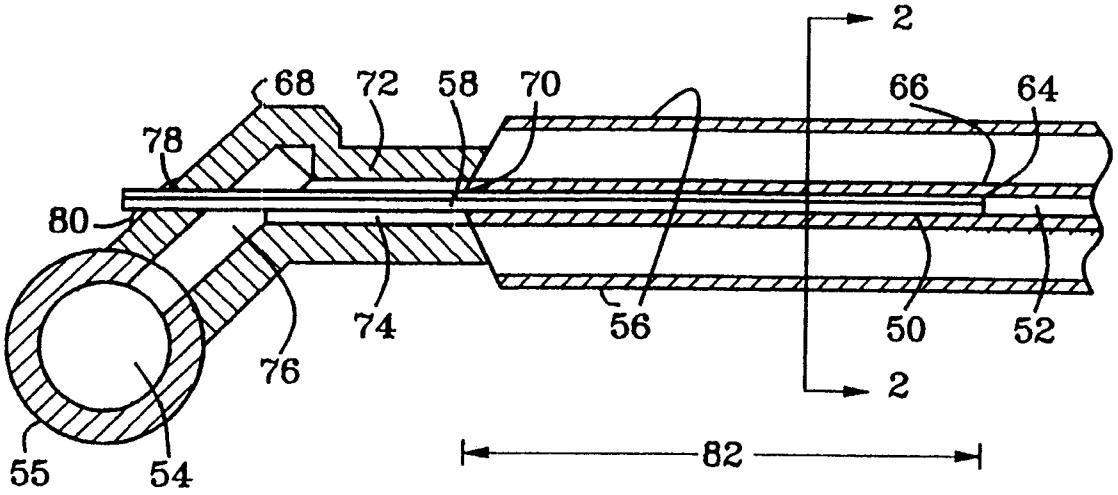
FIG. 1 is an elevational view, in cross-section, of a radiator condensation tube having an elongated restriction element mounted in a working fluid flow passageway in accord with the present invention.

FIG. 1 discloses a suitable regulating mechanism for regulating working fluid flow through radiator 10. Condensation tube 50 includes working fluid flow passageway 52 through which working fluid 54 flows in the direction toward liquid outlet manifold 55. Fluid flow passageway 52 will typically have a mixture of vapor and liquid working fluid 54 prior to the beginning of subcooling. In a preferred embodiment, fully liquified working fluid 54 flows out of radiator 10 from liquid outlet manifold 55. Heat radiation surfaces 56 are in thermal contact with condensation tube 50 and conduct heat away from working fluid flow passageway 52 through condensation tube 50.

Figure 2A:
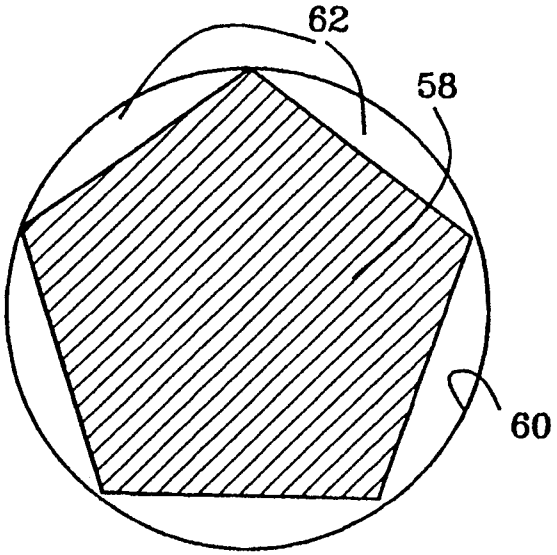
FIG. 2*a* is an enlarged elevation view, in section, of the cross-sectional flow area shown generally in FIG. 2.
Figure 2:
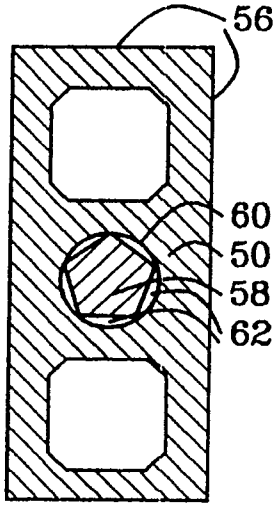
FIG. 2 is a cross-sectional view of FIG. 1 along the lines 2—2.

In a preferred embodiment, restriction element 58 is used to regulate working fluid flow through condensation tube 50 and other parallel condensation tubes 12 in radiator 10. In a preferred embodiment, restriction element 58 has a pentagonal cross-section as shown in FIG. 2 and in greater detail in FIG. 2*a*.

The pentagonal blocker was chosen for this design because it provides a desired reduced flow area 62. Flow area 62 is reduced about 75% due to the pentagonal cross-sectional geometry as shown in FIG. 2*a*. For at least this design, an elongated square restriction element would not decrease the flow area enough to be effective, and an elongated hexagonal restriction element would increase the pressure drop by too great an amount. The elongated nature of restriction element 58 acts to produce a frictional resistance to flow of working fluid that especially blocks the flow of partially vaporized working fluid. An orifice that had a much smaller flow area than 62, located at the onset location of subcooling, would be necessary to produce a similar regulating effect caused by the combination of cross-sectional size and length of restriction element 58. The elongated restriction member used to produce a distributed restriction is preferably positioned at least from point of onset of subcooling 66 to outlet 70. End 64 of restriction element 58 may be disposed at expected point 66 for the onset of subcooling. Subcooling involves cooling the working fluid below its saturation temperature. The location of point 66, which is the point of onset of subcooling, in condensation tube 50 can be calculated for normal working conditions. On the other hand, elongate restriction member 58 may extend significantly past point 66 where subcooling is calculated to begin. Placement past point 66 reduces chances of error in calculation and simplifies manufacturing, although it increases the overall pressure drop of the radiator somewhat. Thus, while the desired result is a distributed restriction in the area of subcooling, actual positioning of an elongate member may vary significantly.

In a preferred embodiment, the maximum diameter of restriction element 58 is slightly undersize with respect to internal diameter of wall 60 of condensation tube 50. The slightly undersize dimension allows ready insertion of restriction element 58 into working fluid passageway 52 to a desired depth as discussed hereinafter.

The point of subcooling in the various condensation tubes 12 disposed along the vapor inlet manifold will vary without the restriction since there will be a pressure difference across the vapor inlet manifold. The pressure drop across the liquid outlet manifold is typically so much less than that of the vapor inlet manifold that it can be effectively disregarded. For cost efficient construction purposes, end 64 is preferably disposed to the same position in each of the tubes when the tubes are equally spaced along the manifolds. The presence of restriction element 58 in each of the tubes acts to equalize the expected point 66 for the onset of subcooling in parallel condensation tubes 12.

However, in alternate preferred embodiments, especially where the tubes are spaced at varying distances from each other, each end 64 may be disposed at varying distances in each of the tubes. It may also be desirable to place end 64 significantly past expected point 66 in each of the tubes. Thus, significant flexibility in placement of end 64 exists. The method of mounting restriction element 58, discussed hereinafter, provides a simple and easily verifiable means to position the restriction element 58.

In a preferred embodiment, restriction element 58 is held in position by saddle assembly 68 which is external to condensation tube outlet 70. Saddle assembly 68 sealingly connects to outlet 70 of condensation tube 50 by welding or other means. Portion 72 includes exit cavity 74 through which restriction element 58 extends. Cavity 74 has a significantly larger diameter than working fluid passageway 52 so that working fluid flow through cavity 74 is not impeded. Cavity 74 connects to saddle outlet port 76 which passes working fluid through to liquid outlet manifold 55. Saddle assembly 68 is thus sealingly connected between liquid outlet manifold 55 and condensation tube 50.

Restriction element 58 extends past outlet port 76 through support port 78 and sealing element or weld 80. Thus, restriction element 58 is disposed in a desired position in working fluid passageway 52 through support port 78, which is then sealed by welding. Saddle assembly 68 is easily manufactured and attached to radiator 10 to keep manufacturing costs at a minimum. Moreover, the positioning of restriction element 58 is readily discernable.

Placement of restriction element 58 in working fluid passageway 52 within anticipated subcooling region 82 provides only a slight increase in fluid flow resistance to liquid fluid flow. However, resistance to fluid flow which includes vaporized fluid is significantly increased. Thus, even if the pressure drop is different among parallel condensing as subcooling onset point 66 varies, and the length of tubes, the flow of working fluid in condensation tubes 12 will tend to be equalized.

As previously stated, resistance to flow is related not only to the size of the cross-sectional flowpath 62 created by restriction element 58, but is also related to the length of restriction element 58. It would be theoretically possible to place an orifice at the expected onset of subcooling point 66 and achieve the regulating effect. However, such an orifice would have to be much smaller in cross-sectional area than flow path 62 to create the same resistance to flow. The smaller size would be difficult to manufacture and would give rise to a problem of potential plugging by debris in the working fluid. It will be appreciated that various cross-sectional shapes and various lengths of restriction elements may be combined in accordance with the teachings of this specification to produce the desired uniformity of flow through multiple condensation tubes which require subcooling. The use of the elongated pentagonal cross-sectional restriction element is thus a preferred embodiment of the present invention.

Figure 4:
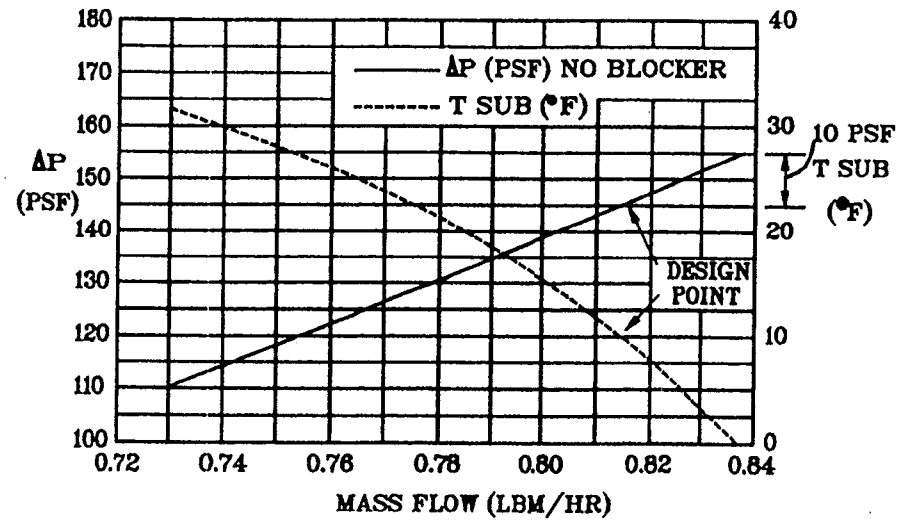
FIG. 4 is graph showing fluid flow rates plated with respect to pressure drop across the tube and subcooling for a condensing tube with no restriction element.
Figure 5:
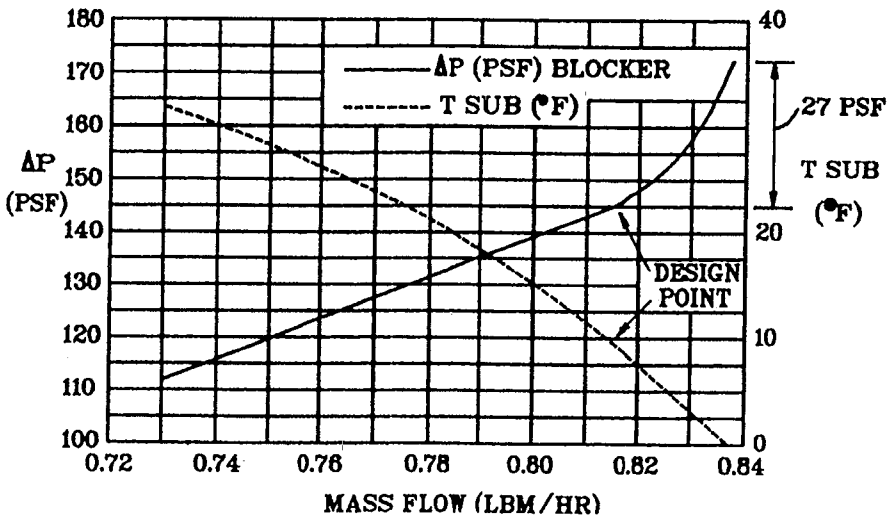
FIG. 5 is a graph showing fluid flow rates plated with respect to pressure drop across the tube and subcooling for a condensing tube including a restriction element in accord with the present invention.

A study of the effect of an elongated restriction element, such as element 58, is disclosed in FIG. 4 and FIG. 5. These figures include information from a test system containing 50 condensation tubes each 121 inches long and 4.73 inches apart. The tubes are separated into two parallel flow paths arranged as those shown in FIG. 3. The manifolds are sized to yield the same anticipated end-to-end pressure drop as the manifolds on a preferred embodiment space-based cooling system. The radiator condensation tube was sized to yield 145 psf (1 psi) of pressure at the design point of full condensation (such as subcooling point 66). In this test design, the fluid inlet temperature is 56° F., the ammonia working fluid is fully vaporized, sink temperature is −35° F., and at the condensing tube outlet, such as outlet 70, subcooling is 10° F. below the inlet temperature.

FIG. 4 shows the results for a plain tube design having no restrictions. For an unrestricted tube, as described above, to have 145 psf (pounds per square foot) pressure drop at design conditions, its internal diameter should be 0.0885 inches. FIG. 4 shows the mass flow rate and outlet temperature of the condensation tube as a function of pressure drop across the tube. Thus, at the design point, the mass flow rate is 0.816 pounds of mass per hour with subcooling of 10° F.

If the vapor manifold pressure drop were 10 psf, then the tube nearest the manifold entrance would have a mass flow rate equal to 0.837 pounds of mass per hour and 0° F. subcooling at the outlet. Thus, vapor blowby from working fluid in a vaporized state would be imminent in the condensation tube nearest the manifold entrance when the condensation tube farthest from the manifold entrance had a flow rate equal to the design point.

FIG. 5 shows results of using a pentagonal restriction element such as restriction element 58. The condensation tube has a 0.090 internal diameter to provide a 145 psf pressure drop at design conditions. The pentagonal restriction element is disposed 3.11 inches into the tube at the outlet end. As in FIG. 4, the design point is a mass flow rate of 0.816 pounds of mass per hour with subcooling of 10° F. In this case, if the manifold pressure drop were 27 psf, the tube nearest the manifold entrance would have a mass flow rate equal to 0.837 pounds of mass per hour and zero subcooling at the outlet when the tube farthest from the manifold entrance had a flow rate equal to the design point.

This shows that the radiator with the pentagonal restriction element can tolerate an input manifold pressure drop 2.7 times higher than a plain tube design and still have comparable performance. The pressure drop across the liquid outlet manifold is typically less than about 1/10 of that across the vapor inlet manifold and is generally not significant.

The results of a more conventional design which has an orifice at each tube outlet are almost identical to those shown in FIG. 4. In this case, a 0.090 inch internal diameter and much smaller diameter orifice is used to provide 145 psf at the tube outlet. The performance is essentially equivalent to that of an unrestricted 0.885 inch internal diameter condensation tube. Thus, the orifice design has no advantages over the design of FIG. 4 for the present system design which requires subcooling in the condensation tube. In operation, a distributed restriction may be placed in the conduit using an elongated restriction member. As discussed herein before, the elongate restriction member may be placed at various places in the conduit with the requirement that it be disposed at least within part of the region of subcooling in the conduit. The conduit is preferably made uniform in cross-section along its length except for the distributed restriction. The distributed restriction now acts to provide greater resistance to vaporized working fluid flow. The distributed restriction does not significantly affect resistance to liquid working fluid flow. In the manner explained, this effect acts to produce more uniform flow through the conduits.

The foregoing description of the invention has been directed in primary part to a particular, preferred embodiment in accordance with the requirements of the patent statutes and for purposes of illustration. It will be apparent, however, to those skilled in the art that many modifications and changes in the specifically described geometrical vapor blocker may be made without departing from the scope and spirit of the invention. Therefore, the invention is not restricted to the preferred embodiment illustrated, but covers all modifications which may fall within the scope of the spirit of the invention.

What is claimed is:

1. A method for controlling working fluid flow through a plurality of conduits connected to a common vapor input manifold, comprising the following steps:
   - introducing working fluid into said vapor input manifold;
   - directing said working fluid through said input manifold to said plurality of conduits;
   - removing heat from said working fluid to condense said working fluid in said conduits;
   - subcooling said working fluid proximate respective outlets of each of said plurality of conduits;
   - forming a flow passageway within at least one of said plurality of conduits having a substantially uniform internal cross-section along at least a portion of its length; and
   - forming an elongate restriction within said flow passageway of said at least one conduit to vary resistance to working fluid flow responsive to vapor content of said working fluid proximate said respective outlet of said at least one conduit.

2. The method of claim 1, wherein the step of forming an elongate restriction within said at least one conduit further comprises the step of slidingly introducing an elongated restriction member into said at least one conduit.

3. The method of claim 1, further comprising the step of:
   - determining an approximate initial point at which subcooling is to begin along the length of said at least one conduit.

4. The method of claim 3, wherein the step of forming an elongate restriction within said at least one conduit further comprises the step of slidingly introducing an elongated restriction member within said at least one conduit adjacent said approximate initial point at which subcooling is calculated to begin.

5. The method of claim 3, wherein the step of forming an elongate restriction within said at least one conduit further comprises the step of slidingly introducing an elongated restriction member within said at least one conduit at a position between said approximate initial point and said respective outlet of said at least one conduit.

6. The method of claim 3, wherein the step of forming an elongate restriction within said at least one conduit further comprises the step of:
   - disposing an elongated restriction member to extend across the entire length between said respective outlet and said approximate initial point of said at least one conduit.

7. The method of claim 1, wherein the step of forming an elongate restriction within said at least one conduit further comprises the step of slidingly introducing a pentagonal shaped cross-sectional restriction element within said at least one conduit.

8. The method of claim 7, further comprising the step of supporting said pentagonal shaped restriction element at a position external to said first outlet of said first conduit.

9. A method for controlling working fluid flow through a plurality of conduits connected between a common input manifold and a common output manifold, comprising the following steps:
   - introducing vaporized working fluid to said input manifold to direct working fluid flow to said plurality of conduits;
   - removing heat from said working fluid to condense said working fluid in said conduits;
   - determining an approximate initial point at which subcooling is to begin along the length of a first conduit of said plurality of conduits; and
   - disposing a restriction member along said first conduit substantially between said approximate initial point and a first outlet of said first conduit to reduce the cross-sectional flow area of said first conduit adjacent said first outlet.

10. The method of claim 9, wherein said step of disposing a restriction member further comprises the step of:
   - disposing said restriction member across the entire length between said first outlet and said initial point of said first conduit.

11. The method of claim 10, wherein said step of disposing a restriction member further comprises the step of:
   - disposing an elongated restriction member into said first outlet and supporting said elongated restriction member at a point external to said first outlet of said first conduit.

12. The method of claim 11, further comprising the step of:
   - disposing a second elongated restriction member into a second outlet of a second conduit to a different depth as compared to the depth of insertion of said first elongated restriction in said first conduit.

* * * * *